US012698544B2

(12) United States Patent
Thiessen et al.

(10) Patent No.: US 12,698,544 B2
(45) Date of Patent: Aug. 4, 2026

(54) HIGH STRENGTH, COLD ROLLED STEEL WITH REDUCED SENSITIVITY TO HYDROGEN EMBRITTLEMENT AND METHOD FOR THE MANUFACTURE THEREOF

(71) Applicants: ThyssenKrupp Steel Europe AG, Duisburg (DE); JFE Steel Corporation, Tokyo (JP)

(72) Inventors: Richard G. Thiessen, Malden (NL); Manuela Irnich, Rheinberg (DE); Nicholas Winzer, Düsseldorf (DE); Shigehiro Takajo, Tokyo (JP); Lingling Yang, Tokyo (JP); Yuki Toji, Tokyo (JP)

(73) Assignees: ThyssenKrupp Steel Europe AG, Duisburg (DE); JFE Steel Corporation, Tokyo (JP)

( * ) Notice: Subject to any disclaimer, the term of this patent is extended or adjusted under 35 U.S.C. 154(b) by 0 days.

(21) Appl. No.: 18/871,128

(22) PCT Filed: Jun. 5, 2023

(86) PCT No.: PCT/EP2023/064912
§ 371 (c)(1),
(2) Date: Dec. 2, 2024

(87) PCT Pub. No.: WO2023/233036
PCT Pub. Date: Dec. 7, 2023

(65) Prior Publication Data

US 2025/0171871 A1 May 29, 2025

(30) Foreign Application Priority Data

Jun. 3, 2022 (WO) ..... PCT/EP2022/065261

(51) Int. Cl.

| | |
|---|---|
| ***C22C 38/00*** | (2006.01) |
| ***C21D 1/18*** | (2006.01) |
| ***C21D 6/00*** | (2006.01) |
| ***C21D 8/02*** | (2026.01) |
| ***C21D 8/0221*** | (2026.01) |
| ***C21D 8/0247*** | (2026.01) |
| ***C21D 8/0278*** | (2026.01) |
| ***C21D 9/52*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.
CPC ..... *C21D 9/52* (2013.01); *C21D 1/18* (2013.01); *C21D 6/004* (2013.01); *C21D 6/005* (2013.01); *C21D 6/008* (2013.01); *C21D 8/02* (2013.01); *C21D 8/0226* (2013.01); *C21D 8/0236* (2013.01); *C21D 8/0263* (2013.01); *C21D 8/0278* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C22C 38/001; C22C 38/002; C22C 38/02; C22C 38/04; C22C 38/06; C22C 38/42; C22C 38/44; C22C 38/46; C22C 38/48; C22C 38/50; C22C 38/54; C22C 38/58; C21D 2211/001; C21D 2211/002; C21D 2211/005; C21D 2211/008
USPC ..... 428/684
See application file for complete search history.

(56) References Cited

U.S. PATENT DOCUMENTS

| | | | |
|---|---|---|---|
| 9,650,708 B2 | 5/2017 | Becker et al. | |
| 2017/0107591 A1* | 4/2017 | Takashima | C22C 38/14 |

FOREIGN PATENT DOCUMENTS

| | | | |
|---|---|---|---|
| EP | 2524970 | A1 | 11/2012 |
| EP | 3128023 | A1 | 2/2017 |
| EP | 3279362 | A1 | 2/2018 |
| JP | 2006183140 | A | 7/2006 |
| JP | 2010285636 | A | 12/2010 |
| JP | 2011202207 | A | 10/2011 |
| JP | 2014518945 | A | 8/2014 |
| JP | 2016194138 | A | 11/2016 |

(Continued)

*Primary Examiner* — Katherine A Christy
(74) *Attorney, Agent, or Firm* — The Webb Law Firm

(57) ABSTRACT

A high strength, cold rolled steel flat product, and a method of its manufacture, with reduced sensitivity to hydrogen embrittlement including a steel substrate which, in % by mass, consists of C: 0.20 to 0.40%, Mn: 1.50 to 3.00%, Si: 0.90 to 1.50%, Al: 0.005 to 1.00%, V: 0.07 to 0.30%, optionally Cr: 0.01 to 1.00%, optionally Mo: 0.005 to 0.20%, optionally B: 0.00001 to 0.002%, optionally Nb and Ti the total content of Nb and Ti being 0.005 to 0.2%, P: up to 0.020%, S: up to 0.005%, N: up to 0.008%, and as the remainder Fe and unavoidable impurities, the sum of the shares of the impurities being ≤0.8%.

11 Claims, No Drawings

(56) References Cited

FOREIGN PATENT DOCUMENTS

| | | | |
|---|---|---|---|
| JP | 2021503040 | A | 2/2021 |
| KR | 1020140024903 | A | 3/2014 |
| KR | 1020170131606 | A | 11/2017 |
| WO | 2015151427 | A1 | 10/2015 |
| WO | 2019063081 | A1 | 4/2019 |

* cited by examiner

HIGH STRENGTH, COLD ROLLED STEEL WITH REDUCED SENSITIVITY TO HYDROGEN EMBRITTLEMENT AND METHOD FOR THE MANUFACTURE THEREOF

CROSS-REFERENCE TO RELATED APPLICATIONS

This application is the United States national phase of International Patent Application No. PCT/EP2023/064912 filed Jun. 5, 2023, and claims priority to International Patent Application No. PCT/EP2022/065261 filed Jun. 3, 2022, the disclosures of which are hereby incorporated by reference in their entireties.

BACKGROUND OF THE INVENTION

Field of the Invention

The invention relates to a high strength, cold rolled steel flat product with reduced sensitivity to hydrogen embrittlement and a method for the manufacture of such steel flat product.

Description of Related Art

"Steel flat products" are understood here to mean rolled products whose length and width are each significantly greater than their thickness. Steel flat products thus include in particular steel strips, steel sheets and blanks obtained from them.

All information on contents of the steel alloy compositions indicated in the present application are related to mass, unless explicitly stated otherwise. All % data referring to the composition of a steel alloy or another alloy mentioned here without referring to a reference unit, should therefore be understood as information in "% by mass" ("mass %").

In order to achieve emission reductions in the automotive and transportation industries through light weighting while increasing passenger safety, steel flat products with increased strength combined with improved ductility are needed. The conflicting goals of strength and ductility have been brought together in advanced 3rd generation high strength steel concepts (so called "AHSS"). These include steels known as "quench and partitioning" steels ("Q&P steels").

Q&P steels use retained austenite ("RA") as a component of the microstructure to improve the strain hardening and tensile strength of the steel, while increasing elongation through the transformation-induced-plasticity ("TRIP") effect, which is also well known. The retained austenite is embedded in a matrix of quenched and tempered martensite (primary martensite). Small amounts of bainite (bainitic ferrite), polygonal ferrite and fresh martensite (secondary martensite) may also be present in the microstructure of Q&P steels.

As the tensile strength increases, so does the risk of sensitivity to hydrogen embrittlement, which can cause an unexpected drop in ductility and strength.

It is known, that the addition of microalloying elements such as Ti, Nb or V can minimize the sensitivity of a steel to hydrogen embrittlement. The microalloying elements form fine carbides or carbonitride precipitates, which are coherent or semi-coherent in the order of <10 nm, preferably <5 nm.

The precipitates formed by the micro alloying elements are often referred to in the skilled literature as "traps for diffusible hydrogen". That is because the hydrogen atoms have a relatively strong binding energy on such fine precipitates. Accordingly, the hydrogen atoms penetrating a steel in whose microstructure these fine precipitates are present bind to the interface of the precipitates or to dislocations resulting from the misfit of the precipitates with the surrounding matrix.

A large number of such traps in the matrix slows down the diffusion of hydrogen atoms through the microstructure and thus reduces their negative influence on the processes occurring during deformation and fracture.

However, the use of microalloying elements in combination with Q&P steels is not trivial. As the microalloying elements form carbides with carbon present in the steel, a part of that carbon is consumed, which is needed during partitioning to stabilize the retained austenite.

SUMMARY OF THE INVENTION

Against this background the invention should specify a high-strength, readily formable steel flat product with reduced tendency to hydrogen embrittlement.

This object is solved by a steel flat product which has at least the features as described herein.

In addition, the invention should specify a process which permits a reliable manufacture of such a steel flat product.

This object is solved by the process as described herein.

Advantageous embodiments of the invention, along with the general idea of the invention, are explained in detail hereinafter.

According to the invention a high strength, cold rolled steel flat product with reduced sensitivity to hydrogen embrittlement thus consists of, in % by mass, C: 0.20 to 0.40%,
Mn: 1.50 to 3.00%,
Si: 0.90 to 1.50%,
Al: 0.005 to 1.00%,
V: 0.01 to 0.30%,
optionally Cr: 0.01 to 1%,
optionally Mo: 0.005 to 0.2%,
optionally B: 0.00001 to 0.002%,
optionally Nb and Ti the total content of Nb and Ti being 0.005 to 0.2%,
P: up to 0.020%,
S: up to 0.005%,
N: up to 0.008%,
and as the remainder Fe and unavoidable impurities, the sum of the shares of the impurities being ≤0.8%, and exhibits a microstructure consisting of, in % by area, 65 to 92% primary (tempered) martensite and
at least 8% retained austenite (RA),
the remainder being filled by
- up to 27% of secondary (un-tempered) martensite,
- up to 10% of bainite or bainitic ferrite,
- and/or up to ≤5% polygonal ferrite,
- the sum of the shares of the secondary (untempered) martensite, the bainite or bainitic ferrite and the polygonal ferrite being ≤27%.

The steel flat product according to the invention has a tensile strength of at least 1300 MPa, typically ranging from 1300 to 1600 MPa, a yield strength of at least 1000 MPa, a total elongation A80 of at least 10%, the tensile strength, the yield strength and the elongation each being determined in accordance with currently valid DIN EN ISO 6892 (Sample form 2).

The good formability of the steel flat product according to the invention, despite its high strength, is also reflected in a hole-expansion HER of more than 20%, the hole-expansion HER being determined in accordance with currently valid ISO 16630.

Furthermore, extensive tests have proven that the steel flat product according to the invention has an increased resistance towards hydrogen embrittlement as quantified in slow-strain-rate-tests performed according to currently valid DIN EN ISO 7539-7 with and without a hydrogen-charging medium.

DESCRIPTION OF THE INVENTION

The present invention thus possesses significant advantages for structural and crash-relevant components in the automotive and transportation industry, including applications such as the battery-housing in electric vehicles. These applications require both a high yield strength and a large capacity to absorb plastic deformation. The high yield strength ensures minimal intrusions in crash situations while the high elongation values enables a large energy absorption.

The method proposed by the invention for the production of a steel flat product according to the invention comprises the following working steps:

a) Providing a steel melt consisting of, in % by mass, C: 0.2 to 0.4%, Mn: 1.5 to 3.0%, Si: 0.9 to 1.5%, Al: 0.005 to 1.0%, V: 0.01 to 0.3%, optionally Cr: 0.01 to 1%, optionally Mo: 0.005 to 0.2%, optionally B: 0.00001 to 0.002%, optionally Nb and Ti the total content of Nb and Ti being 0.005 to 0.2%, the P: up to 0.020%, S: up to 0.005%, N: up to 0.008%, and as the remainder Fe and unavoidable impurities, the sum of the shares of the impurities being ≤0.8%, b) casting the steel melt into a slab;

c) heating through the slab to a reheating temperature of 1000 to 1300° C.;

d) hot rolling the reheated slab into a hot strip, wherein the hot rolling is finished at a hot rolling finish temperature of 850 to 980° C.;

e) cooling the hot strip to a coiling temperature of 400 to 600° C., the cooling being finished within a maximum of 25 s after the finish of the hot rolling, and coiling the hot strip into a coil;

f) optionally pickling the hot strip;

g) cold rolling the hot strip into a cold strip with cold reduction rates of 20 to 80%.

h) final annealing of the cold strip by heating the cold strip to a soaking temperature TS, which is at least 50° C. higher than the Ac3 temperature of the respective steel and 950° C. at most, with a heating rate ΘS of 2 to 10° C./s, immediately followed by holding the cold strip at the soaking temperature TS for a soaking time tS of more than 40 s and less than 200 s;

immediately followed by quenching the cold strip with a quenching rate ΘQ of 20 to 100° C./s to a quenching stop temperature TQ which is lower than the martensite start temperature T_MS of the steel and at least equal to that temperature TQ_min at which in the microstructure of the cold strip 65 to 92% by area primary martensite is present; and holding the annealed cold strip at the quenching stop temperature TQ for 4 to 20 s;

i) over-ageing the final annealed cold strip the over ageing treatment (also called "partitioning treatment") comprising heating the cold strip to an over-ageing temperature TP of 380 to 460° C.

holding the cold strip at the over-aging temperature for 50 to 200 s, and cooling the cold strip to less than 100° C. with a cooling rate ΘC of 0.5° C./s to 20° C./s.

To protect the steel flat product according to the invention against corrosion an anti-corrosion coating can be provided on at least one of its surfaces in a common manner. Such coating can be applied by electrolytically coating, hot-dip galvanizing or galvannealing. Typically, the coating consists of an alloy which main component is zinc ("Zn") or aluminum ("Al") and to which, in a manner well known, too, further alloying elements, such as silicon ("Si"), magnesium ("Mg") and iron ("Fe") can be added to optimize the coating's properties.

The composition of the steel the substrate of a steel flat product according to the invention was determined as follows:

0.20 to 0.40% by mass carbon ("C") are present in the steel of the steel flat product according to the invention. C is an essential element in terms of increasing the strength of a steel sheet and reliably obtaining a required amount of stable retained austenite in the microstructure. The retained austenite is stabilized up to room temperature during quenching performed in the course of the final annealing (working step h) of the method according to the invention) and in the subsequent over-ageing process step (working step i) of the method according to the invention) by carbon diffusion and partitioning. For the stability of the retained austenite phase a C content of at least 0.20% by mass, is necessary. Furthermore, the required amount and strength of the martensite formed during first quenching (working step h) of the method according to the invention) or during final quenching (working step i) of the method according to the invention) to a temperature of less than 100° C., particularly to room temperature, is determined by the carbon content. Steel sheets with carbon content lower than 0.2% would not show sufficiently high strength combined with a good formability. If, however, the C content exceeds 0.4% by mass the martensite start temperature would significantly lowered which would result only in small amounts of martensite and thus lower the strength level. Moreover, carbon contents greater than 0.4% would deteriorate the welding properties of a steel sheet according to the invention. The positive effects, C has on the properties of the steel flat product according to the invention can particularly reliably obtained with C contents of at least 0.22% by mass. The presence of C in the steel flat product according to the invention is especially effective at C contents of 0.3% by mass at most.

1.50 to 3.00% by mass of manganese ("Mn") are added to the steel of the steel flat product according to the invention. Mn is an element that effectively increases the hardness and thus the strength of the steel. Furthermore, by the presence of Mn contents in the range defined by the invention the formation of ferrite and pearlite during quenching is suppressed. By using quenching rates <100° C./s a suitable microstructure, containing martensite and retained austenite after first quenching (working step i)) is obtained. Mn also is a solid solution strengthening element that stabilizes the austenite by lowering the Ms-temperature. To reliably obtain these positive effects of the presence of Mn at least 1.5% by mass, particularly at least 1.9% by mass of Mn, are needed in the steel of the flat product according to the invention. High Mn contents of more than 3.00% by mass would, however, worsen the welding properties and cause segregations which would deteriorate the mechanical properties of the steel flat product as well. To reliably avoid these negative influences of the presence of Mn, the Mn content in steel of the flat product according to the invention can be limited to 2.8% by mass.

0.90 to 1.50% by mass of silicon ("Si") are present in the steel of the steel flat product according to the invention. Si contributes to the strength of the steel by solid solution strengthening. Furthermore, silicon is insoluble in cementite and thus suppresses the formation of iron carbides during partitioning (working step i)) and supports the stabilization of retained austenite, which results in an improved ductility. For these effects, at least 0.90% by mass of Si are needed in the steel of the steel flat product according to the invention. Furthermore, Al in combination with 0.9% Si shows a similar effect on the stabilization and amount of retained austenite resulting in an improved ductility. High silicon contents of more than 1.50% by mass would, however, be detrimental to the coatability of the steel sheet.

The steel of the flat steel according to the invention contains 0.005 to 1.00 mass % aluminum ("Al"). Al is commonly used in steelmaking as a deoxidizer and to form aluminum nitrides, which contribute to the strength of the steel. Like Si, Al is not soluble in cementite and therefore suppresses its formation of iron carbides during decomposition (working step i)). However, with increasing aluminum content, the Ac3 temperature of the steel from which the flat product of the invention is made would increase dramatically to values too high for usual industrial annealing lines. If Al is to be used only as a deoxidizing agent, the Al content can be limited to a maximum of 0.1% by mass in order to avoid the formation of AlN. In order to use Al for deoxidation, Al contents of at least 0.005 mass % are required. Typically, in a steel alloy according to the invention Al contents for these purposes are in the range of 0.005-0.100% by mass, particularly 0.005-0.070% by mass or 0.005-0.060% by mass. If, however, Al is required in order to promote the retention of austenite then a concentration of up to 1.0% is permitted. In this case, Al contents of at least 0.060 mass %, in particular at least 0.1 mass % or at least 0.3 mass % are appropriate.

The vanadium ("V") content of the steel the steel flat product according to the invention is made of ranges from 0.01 to 0.3% by mass. V is a micro-alloying element whose dissolution temperature is much lower than Ti or Nb. This allows the V-based precipitates to be partially or completely dissolved during the final annealing (working step h)) and precipitate during the subsequent cooling or, most preferably, during in the course of the partitioning stage of the final annealing cycle (working step i)) by carbon diffusion and partitioning. This allows particularly fine V-based precipitates to be formed which are especially effective for trapping diffusible hydrogen. The positive effect of V becomes noticeable at concentrations above 0.01% by mass and continues to constantly increase up to 0.15% by mass. A saturation of this effect is observed at concentrations above 0.3% by mass. In the range of up to 0.25% by mass, particularly up to 0.20% by mass, the presence of V turns out to be most effective. This applies in particular if the V content is at least 0.07% by mass.

Chromium ("Cr") can optionally be added to the alloy of the steel the steel substrate of the flat product according to the invention is made of for retarding the formation of pearlite and bainite effectively and increasing the strength. This effect can be achieved by adding at least 0.01% by mass of Cr. However, to avoid the occurrence of grain boundary oxidation, the Cr content is limited to 1% by mass. The presence of Cr in the steel of the flat product according to the invention is particularly effective at Cr contents of at least 0.1% by mass. To avoid negative influences of the presence of Cr the Cr content can be limited to 0.5% by mass.

As a further optional element 0.005 to 0.2% by mass of molybdenum ("Mo") can be added to the alloy of the steel the steel flat product according to the invention is made of. Mo improves the strength of the steel sheet and suppresses the formation of pearlite. Especially effective in this regard are Mo contents of at least 0.02% by mass, wherein the positive influence of Mo is in particular noticeable at Mo contents of up to 0.15% by mass.

Niobium ("Nb") and titanium ("Ti") are micro-alloying elements which can optionally be added in combination or alone to the steel alloy of the steel flat product according to the invention for effectively contributing to the strength of the steel sheet by precipitation hardening and refining the microstructure. However, the dissolution temperature of Nb and Ti is much higher than the dissolution temperature of V. That means that, for example, if Ti is present in combination with V the formation of mixed-carbides can occur. Mixed-carbides of this kind tend to not dissolve during the final annealing so that they remain coarse or grow to ineffective sizes during the final annealing. For this reason, the sum of the contents of Nb and Ti is limited to a maximum of 0.2% by mass in total. On the other hand, the advantageous effect of the presence of Nb and/or Ti on the strength and formability of the steel flat product can reliably be used at Nb and/or Ti contents which are at least 0.005% by mass in total. Particularly effective with regard to the strengthening of the steel are Nb and/or Ti contents which in sum range from 0.02 to 0.15% by mass.

0.00001 to 0.002% by mass boron ("B") can optionally be added to the steel of the steel flat product according to the invention to suppress the formation of ferrite and segregates along the grain boundaries thus blocking their movement. This results in a fine-grained microstructure contributing to the mechanical properties of the steel. Particularly effective in this regard are B contents in the range of 0.0001 to 0.001% by mass.

The phrase "impurities" include all elements that during steelmaking enter the steel or cannot be completely removed from it. Impurities can probably be detected by measurement in the steel of the flat product according to the invention but are not listed here as mandatory or optional constituents or, in the case of optionally added elements, are present in contents which are so low that they are below the effectiveness limits specified here. To avoid harmful influences of the impurities as a whole, the sum of the contents of the impurities is limited to a maximum of 0.8% by mass in total. In particular phosphorous ("P"), sulfur ("S"), and nitrogen ("N") are unavoidable impurities. However, P contents of up to 0.020% by mass, S contents of up to 0.005% by mass and N contents of up to 0.008% by mass each prove to be not deteriorating the properties of the steel the steel flat product according to the invention. Typically, 0.001 to 0.020% by mass of P, 0.0001 to 0.005% by mass of S and 0.0001 to 0.008% by mass of N are present in the steel. A copper ("Cu") content of up to 0.5% by mass and a nickel ("Ni") content of up to 0.5% by mass as well as an oxygen ("O") content of up to 0.0080% by mass belong to the unavoidable impurities as well. It goes without saying that other elements such as W, Co, Sn, Ca, Mg, REM, Zr, Te, As, Bi etc are also considered as impurities.

The steel flat product according to the invention exhibits a microstructure which comprises 65 to 92% by area primary (tempered) martensite and at least 8% by area of retained austenite (RA). The retained austenite content fills that part of the microstructure not occupied by the primary martensite and the other microstructural constituents which are optionally permitted according to the invention. Thus, if no other constituent is present in the microstructure of the steel, the retained austenite occupies 8 to 35% by area of the microstructure. If, however, only the minimum amounts of primary (tempered) martensite of 65% by area and retained austenite of 8% by area are present in the microstructure, a total of 27% by area of the constituents can be present which according to the invention are optionally permitted. Theoretically the respective remaining share of the microstructure can be filled by the secondary (untempered) martensite alone, by the bainite or bainitic ferrite alone and/or by the polygonal ferrite alone, wherein as a rule combinations of these optional constituents will occur.

The microstructure of a steel flat product according to the invention also includes a precipitate density of ≥1000 per $\mu m^2$ of V-based-precipitates with a diameter of less than 10 nm. By this, the steel flat product according to the invention exhibits an improved resistance to hydrogen embrittlement.

The precipitate density of the V-based-precipitates is determined by means of transmission electron microscope images in combination with X-ray microanalysis (TEM and EDX) using carbon extraction replicas. The carbon extraction replicas are obtained from longitudinal sections. The magnification of the measurement is between 10,000× and 200,000×. Based on these images, the diameter of the precipitates in the measuring field can be calculated by means of computer-aided image analysis. In each case, 5 measuring fields are measured for this purpose. The results of the 5 measurement fields are then averaged. The size of the measuring fields depends on the selected magnification and ranges from 18.5 μm×14.5 μm at 10,000× magnification to 0.925 μm×0.725 μm at 200,000× magnification. The nature of the precipitation is simultaneously determined by EDX (energy dispersive X-ray spectroscopy). In this process, the atoms in the precipitates are excited by means of the electron beam from the transmission electron microscope. From the emitted X-rays, the elemental distribution in the sample can be determined so that identification of vanadium precipitates can be achieved.

For example, the density of V precipitates can be determined using the following steps:

1. Providing carbon extraction replicas of a longitudinal section of the steel flat product.
2. Determining the diameter of all precipitates on 5 different measuring fields having a size of 1.85 μm×1.45 μm using TEM and computer-aided image analysis at a magnification of 100,000 times
3. Identification of the vanadium precipitates based on the detected X-ray quanta
4. Calculation of the number of vanadium precipitates with a diameter smaller than 10 nm in each of the 5 measuring fields and determination of the density of the vanadium precipitates in each of the 5 measuring fields
5. Determination of the density of the vanadium precipitates of the steel flat product as the mean value of the density over the 5 measuring fields.

If the austenite grains are too large, the nucleation sites for martensite are reduced and could cause over-dimensioned martensite packets, which in turn would decrease local formability of the final product. The width of the individual martensite laths is a function of their length. Thinner laths are advantageous to support the microstructural processes that take place during the over aging treatment (working step i) of the method according to the invention). The precipitation of fine V-based-precipitates according to the invention along the phase boundary of the martensite and retained austenite grains cause a fine lath thickness with a length of 1000 nm at most, wherein a length of 500 nm at most is regularly obtained. The microstructure can be determined using transverse sections at ⅓t layer, i.e. on sections which were taken at one third of the plate thickness of the steel substrate.

The sections are prepared for scanning electron microscopy (SEM) and treated with a 3% Nital etch. Due to the fineness of the microstructures, the microstructure is examined by means of SEM observation at 5000× magnification. The determined lath thickness length corresponds to the mean value of five measurements.

Furthermore, the precipitations located at the phase boundary act as traps for hydrogen thus yielding an improved resistance against hydrogen embrittlement. By managing the microstructure by precipitating fine V-based-precipitates along the phase boundary of the martensite and/or retained austenite grains, the hydrogen embrittlement resistance and the mechanical properties become excellent. The fine V(C,N) precipitates which are formed as a result of the alloy specified by the invention and the method of manufacturing the steel flat product according to the invention thus cause a finer prior austenite grain which also results in a thinner martensite/retained austenite lath structure. The V(C,N) nanoparticles are located along the lath interfaces where they trap hydrogen penetrating the steel substrate, thus leading to improved resistance to hydrogen embrittlement.

The properties of the steel flat product according to the invention explained above can reliably obtained with the method the invention proposed for the manufacture of such steel flat products.

For manufacturing a steel flat product according to the invention, a steel melt which has a composition corresponding to the specifications of the invention is prepared in a common manner. The melt is then cast in a conventional manner as well to form at least one slab (steps a) and b) of the process according to the invention).

In preparation of the subsequent hot rolling the slab is reheated up to a temperature in the range of 1000-1300° C. or, if the slab's temperature after casting is high enough, held in this temperature range to equalize the temperature over the complete volume of the slab (working step c) of the method according to the invention).

In working step d) of the method according to the invention hot rolling of the slab into a hot strip is performed at sufficiently high temperatures so that the finish rolling temperature is in the range of 850° C. to 980° C. If the temperatures during hot rolling would be lower, no sufficient static recrystallization would take place between the rolling steps. The resulting microstructure would thus retain a strong texture and a high dislocation density due to dynamic recrystallization. For this reason, the finish rolling temperature must not be lower than 850° C. Finishing rolling temperatures higher than 980° C. are technically not feasible.

According to step e) of the method according to the invention the cooling of the hot strip obtained to the coiling temperature should be finished within 25 s at most after the end of the hot rolling to avoid precipitation or the formation of polygonal ferrite on the run-out table the hot strip passes before being coiled. Preferably, the cooling is finished within 18 s at most, even more preferably at 15 s at most to prevent this effect.

In working step e), The cooling to the coiling temperature can be carried out in any manner known in the prior art with cooling rates typically ranging from 20° C./s to 1000° C./s. High cooling rates can be achieved by water quenching, for example.

The coiling temperature should be 600° C. at most to avoid the formation of pearlite. In addition, at higher coiling temperatures oxidizing elements, such as Si, Cr or Mn, would diffuse to the grain boundaries and form oxides which will lead to a lesser surface quality of the hot-rolled material and thus limited surface quality after hot rolling and optional coating of the steel flat product. Further, limiting the coiling temperature to 600° C. at most also prevents the development of unwanted polygonal ferrite. Coiling temperatures of lower than or up to 580° C. increase the amount of bainite in the microstructure of the hot-rolled material. By setting lower coiling temperature of 400° C. to 500° C. a positive effect with regard to avoiding grain boundary oxidization can be obtained. However, low-coiling temperatures could also promote the formation of large amounts of martensite resulting in a high hardness of the hot rolled strip so that a batch annealing, which is typically carried out at temperatures in the range of 550° C. to 600° C. for more than 6 hours and less than 24 hours to decompose the bainite/martensite, becomes necessary for cold-rolling. A uniform microstructure without the large amounts of martensite enabling narrow tolerances in thickness and width during subsequent cold rolling can thus reliably obtained by coiling the hot strip at coiling temperatures of 400° C. to 600° C., preferably of 400° C. to 580° C., coiling temperatures of 500° C. to 580° C. being especially useful.

After coiling and cooling the hot strip to room temperature as a coil the hot strip can be descaled in a common manner, if needed, for example by pickling, to remove scale which is present on the surface of the strip or to enhance the surface quality (optional working step f) of the method according to the invention).

The cold rolling usually is carried out in a conventional tandem-rolling mill in one or more rolling steps with an intermediate batch-annealing performed as described above, if needed. For cold-rolling, a reversing rolling stand can be used to realize a higher amount of reduction. Here, expediently a cold-reduction of up to 80% should be achieved. The minimum reduction usually obtained during cold-rolling should be 20% to ensure a sufficient recrystallization during the final annealing step (step h) of the method according to the invention). However, higher amounts of reduction are helpful to obtain a fine-grained microstructure, which leads to the described product properties. Accordingly, in the method according to the invention a cold reduction of 20% to 80% is appropriate when cold rolling the hot strip into the cold strip (working step g) of the method according to the invention).

The heat treatment steps h) and i) of the method according to the invention are preferably carried out in a heat treatment line through which the respective steel flat product passes in a continuous, uninterrupted sequence.

In the course of the final annealing of the cold-rolled strip carried out as working step h) of the method according to the invention the majority of the properties of the steel flat product according to the invention become adjusted. The heating of the cold-rolled strip to the soaking temperature TS should performed with an average rate "ΘS" of 2 to 10 C/s. Heating rates above 10° C./s would endanger a proper recrystallization before the austenitization and heating rates below 2° C./s are not economical in a continuous annealing line. The soaking temperature TS should be at least 50° C. above the Ac3 temperature of the respective steel composition to ensure a proper homogenization of C within the fully austenitic microstructure.

The Ac3 temperature of the given composition can be determined experimentally in a known manner using dilatometry or estimated according to the following Equation (1):

$$Ac3[°C.] = 910°C. + (-203\sqrt{(\%\ C)} - 15.2\%\ Ni + 44.7\%\ Si + 31.5\%\ Mo - 21.1\%\ Mn))°C./\%\ by\ mass$$

with % C=respective C content of the steel alloy in % by mass,

% Ni=respective Ni content of the steel alloy in % by mass,

% Si=respective Si content of the steel alloy in % by mass,

% Mo=respective Mo content of the steel alloy in % by mass,

% Mn=respective Mn content of the steel alloy in % by mass.

For the steel alloys covered by the alloying specification of the invention, the Ac3-temperatures typically range from approximately 750° C. to approximately 920° C. The Ac-3 temperatures for the steel alloys covered by the alloying specification of the invention are determined experimentally by dilatometry according to September 1681-1998-06. For the determination a dilatometer is used and the averaged coefficient of thermal expansion of the steel sample is compared to the thermal expansion of a quartz tube. The quartz tube expands linearly with temperature over a very wide temperature range (well over 1000° C.), while the steel sample undergoes transformations, both on heating and cooling. The variation in linear expansion with equally increasing or decreasing temperature is recorded and shows the transformation temperatures. Dilatometers that are commercially available can be used for this purpose, such as, e.g., a Bähr 805 dilatometer.

The upper limit of the soak temperature TS is 950° C. to allow sufficient dissolution of any V-carbides in the semi-finished product. The soaking time tS should be long enough to allow chemical homogenization and carbide dissolution. At the same time, however, it must be limited enough to prevent excessive austenite grain growth.

To promote the precipitation of V(C,N) precipitates, the soaking time tS should be at least 40 s, preferably more than 40 s, and 200 s at most (40 s≤tS≤200 s), preferably shorter than 200 s (40 s<tS<200 s). Soaking times tS of more than 60 s and shorter than 120 s (60 s<tS<120 s) are especially useful here.

Following the soaking stage, the strip enters a primary cooling step. The average cooling rate "ΘQ" with which the steel flat product according to the invention is cooled in the primary cooling step has to be high enough to minimize the formation of polygonal ferrite, bainite, bainitic ferrite and any precipitated carbides. The lower limit for the cooling rate ΘQ is thus set to 20 C/s. The upper limit of ΘQ is determined by process stability and cooling capacity of the primary cooling step. Increasing the cooling capacity of the primary cooling step to rates above 100° C./s is not necessary for the proposed invention. Instead, a cooling rate of more than 100° C./s during primary cooling would increase production costs and lead to under-cooling, which would be detrimental to the mechanical properties of the final product.

The cooling rate ΘQ is thus set to 20° C./s to 100° C./s, preferably to 30° C./s to 70° C./s.

The quenching stop temperature TQ at which the cooling performed in this way stops at the end of the primary cooling step, has to be lower than the martensite start temperature T_MS.

The martensite start temperature T_MS can be determined experimentally by dilatometry in a known manner or estimated according to the following Equation (2):

$$T_MS[°C.]) = 539°C. + (-423\%\ C - 30.4\%\ Mn - 7.5\%\ Si + 30\%\ Al)°C./\%\ \text{by mass}$$

with % C=respective C content of the steel alloy in % by mass,

% Mn=respective Mn content of the steel alloy in % by mass,

% Si=respective Si content of the steel alloy in % by mass,

% Al=respective Al content of the steel alloy in % by mass.

For the steel alloys covered by the alloying specification of the invention, the T_MS temperatures typically range from approximately 265° C. to approximately 435° C.). The T_MS temperatures for the steel alloys covered by the alloying specification of the invention are determined experimentally by dilatometry according to September 1681-1998-06. The measurement is known to the skilled person and is carried out using a dilatometer as described above in the context of the determination of the Ac3 temperatures.

The quenching stop temperature must not be lower than a temperature TQ_min at which in the microstructure of the cold strip 65 to 92% by area primary martensite is present (T_MS≥TQ≥TQ_min).

To determine the fraction of primary martensite after the initial quench, and thereby obtaining the temperature TQ_min, the Koistinnen-Marburger equation can be used. The equation is often expressed as follows:

$$f_m = 1 - \exp(-0.011(T_MS - TQ))$$

where $f_m$ is the fraction of austenite that transforms to martensite upon quenching to a temperature TQ below the T_MS (Speer, et al., MS&T 2003, pp. 505-522, 2003). According to the present invention, the amount of primary martensite should not exceed 92% by area and not be lower than 65% by area.

Immediately following the primary cooling, the steel flat product according to the invention is held at the respective quenching temperature TQ for at least 4 s and for not more than 20 s. This holding is necessary to homogenize the temperature through the sheet thickness and to enable the final stage of the isothermal transformation to take place.

Following the holding step, the steel flat product enters the overaging step i) of the method according to the invention, which is also referred to in the skilled terminology as the "separation step". In step i), C is partitioned from the primary martensite toward the adjacent retained austenite. However, the separation of C is a thermally activated process that competes with the precipitation of nanoparticles. That means that if partitioning is performed at too high temperatures or for a too long period, iron carbides could form that would consume much of the carbon needed for retained austenite stabilization and reduce both the tensile strength and elongation of the steel flat product. To avoid this effect, the upper limit of the overaging temperature TP is set by the invention at 460° C. The lower limit of the overaging temperature TP is set at 380° C. to ensure that a sufficient amount of V(C,N) nanoparticles is precipitated, which would not be the case at lower temperatures. In this regard limiting the overaging temperature TP to a maximum of 460° C. proves to be particularly expedient as well because it also avoids coarsening of the V(C,N) nanoparticles, which otherwise would deteriorate the mechanical properties of the steel flat product. By setting the overaging temperature to 380° C. to 460° C. (380° C. TP 460° C.) and limiting the time period tP during which the respective steel flat product is kept at the temperature TP to 50 s to 200 s, a precipitation density of ≥1000 per $\mu m^2$ of V-base precipitates with a diameter of less than 10 nm in the microstructure of the product according to the invention can be reliably achieved.

After expiry of the respective time period tP the annealed strip is cooled down to less than 100° C. with a cooling rate of OC of 0.5° C./s to 20 C/s. By this the partitioning is immediately stopped and any carbide coarsening or other thermal induced effects are avoided which could deteriorate the mechanical properties of the steel flat product according to the invention. After the steel flat product is cooled to less 100° C. the cooling to room temperature is uncritical and can be performed in any appropriate manner.

The improved resistance of the steel flat product of the invention to hydrogen embrittlement was demonstrated by a test carried out in accordance with DIN EN ISO 7539-7. For this purpose, samples of a steel flat product according to the invention were exposed to natural air and other samples of the same steel flat product were exposed to an aqueous-based solution containing 5% NH4SCN as hydrogen-charging medium. Subsequently, the maximum tensile stress Rm_max(air) of the samples exposed to the air atmosphere and the maximum tensile stress Rm_max($NH_4SCN$) of the samples exposed to the hydrogen-charged medium were determined in the usual standard manner. From the tensile stresses thus determined, a "Hydrogen Embrittlement Sensitivity Factor" ("H_sf") was calculated as follows:

$$H_sf = 1 - Rm_max(NH_4SCN)/Rm_max(air)$$

It turned out that for the steel flat products according to the invention the Hydrogen Embrittlement Sensitivity Factor H_sf was reliably 0.35 at most (H_sf≤0.35). Thus, the tests demonstrated that the hydrogen embrittlement sensitivity of the steel flat products according to the invention is significantly lower than the hydrogen embrittlement sensitivity of sheet samples used for comparison, which were subjected to the same test conditions and evaluated in the same way, but which consisted of a conventional steel sheet whose steel was not alloyed in the manner according to the invention, i.e. which in particular lacked the V contents provided for in the invention. Contrary to the inventive samples, the comparative examples regularly show Hydrogen Embrittlement Sensitivity factors H_sf of at least 0.35.

In each of the Tables 1 to 5 explained hereinafter those values that do not comply with the specification of the invention are underlined.

For practical testing and to demonstrate the effects obtained by the invention, steel melts A-M have been melted, the compositions of which are specified in Table 1. In Table 1 those values and examples are underlined that are outside the scope of the invention.

In Table 2 the Ac3 temperatures as determined using dilatometry according to September 1681-1998-06 and the T_MS temperatures as determined using dilatometry according to September 1681-1998-06 are specified for each of the melts A-M.

The melts A-M were cast into slabs which for subsequent hot rolling were reheated to a temperature of 1150-1300° C.

The slabs reheated in this way were hot into a hot strip in a common hot rolling line the hot rolling finish temperature FT ranging from 850 to 980° C. The hot rolling finish temperatures FT kept during hot rolling of the respective steel A to M are also given in Table 2.

After leaving the last hot rolling stand of the hot rolling line the hot strip obtained respectively was cooled within a maximum duration tC of 25 s to the respective coiling temperature CT which was in the range of 400° C. to 600° C. The respective duration tC and the respective coiling temperature CT are indicated in Table 2 as well.

After coiling and cooling to room temperature in the coil, the hot strips were pickled in a manner known to the skilled person to remove scale from their surfaces.

The hot-rolled strips were then rolled into cold-rolled strips in a manner which corresponds to the common way of cold rolling as well. The total cold rolling degrees CRD respectively achieved in the cold rolling process range from 20 to 80%, with the respective cold rolling degree CRD being calculated as follows:

$$CRD = (D1 - D2)/D1 * 100\%$$

with D1: Thickness of the respective hot strip before cold rolling

D2: Thickness of the respective cold strip after cold rolling

The respective cold rolling degree CRD is indicated in Table 2, too.

After the cold rolling samples of the obtained cold strips were final annealed by heating to a soaking temperature TS with a heating rate ΘS immediately followed by holding the respective sample at the soaking temperature TS for a soaking time tS. Immediately after soaking the samples were quenched with a quenching rate ΘQ to a quenching stop temperature TQ so that in the microstructure of the samples annealed in this manner the share % PM of primary martensite was between 65 to 92% by area. Subsequently to the quenching the samples of the annealed cold strips were held over a duration tQ at the quenching stop temperature TQ for 4 to 20 s. The respective soaking temperature TS, heating rate ΘS, soaking time tS, quenching rate ΘQ, quenching stop temperature TQ, proportion % PM of primary martensite (corresponding to tM in Table 5) and duration tQ are indicated in Table 3.

After the final annealing the samples of the cold strips underwent an over-ageing treatment which in the skilled language also is denoted as "partitioning treatment".

For this purpose, the samples were heated to a temperature TP, at which they were then held for a duration tP. Finally, the samples were cooled down with a cooling rate ΘC to a temperature below 100° C. The temperature TP and the duration tP are also listed in Table 3.

For each of the samples processed in this way the yield strength YS, the tensile strength TS, the elongation A80, each determined according to DIN EN ISO 6892 (sample form 2) the ration YS/TS, the whole expansion HER determined according to ISO 16630 and the product TS×A80 are listed in Table 4.

In addition for each of the samples the microstructure was analyzed in accordance with ISO 9042 for optical microscopy. The content of retained austenite RA, the content of primary (tempered) martensite tM, the content of secondary (fresh) martensite fM, the total of the bainite content and the content of bainitic ferrite bF, the content of polygonal Ferrite pF determined in this way are indicated in Table 5.

Furthermore the areal density at which the V(C,N) precipitates were present in the microstructure of the samples was determined by preparation of carbon-replicas and common transmission-electron microscopy.

Finally, the Hydrogen Embrittlement Sensitivity Factor H_sf was determined in the manner described above. It turned out that the samples according to the invention, which fulfilled all the requirements of the invention both in terms of their composition and in terms of the way they were produced and heat treated, had a significantly lower sensitivity for hydrogen embrittlement than those samples which were not alloyed and/or not manufactured and heat treated according to the invention.

TABLE 1

| Steel | C | Si | Mn | P* | S* | Al | Cr | Cu* | Nb | Mo | N | Ti | V | Ni* | B | Ti + Nb |
|---|---|---|---|---|---|---|---|---|---|---|---|---|---|---|---|---|
| | [% by mass] | | | | | | | | | | | | | | | |
| A | 0.158 | 1.18 | 1.99 | 0.014 | 0.0020 | 0.017 | 0.022 | 0.008 | 0.001 | 0.005 | 0.0016 | 0.015 | 0.001 | 0.021 | 0.0015 | 0.016 |
| B | 0.165 | 0.42 | 2.35 | 0.013 | 0.0025 | 0.710 | 0.720 | 0.061 | 0.027 | 0.010 | 0.0042 | 0.023 | 0.003 | 0.041 | 0.0014 | 0.050 |
| C | 0.218 | 1.48 | 2.21 | 0.016 | 0.0023 | 0.024 | 0.173 | 0.047 | 0.001 | 0.010 | 0.0046 | 0.007 | 0.003 | 0.036 | 0.0004 | 0.008 |
| D | 0.274 | 1.47 | 2.31 | 0.005 | 0.0021 | 0.022 | 0.132 | 0.036 | 0.001 | 0.099 | 0.0013 | 0.086 | 0.004 | 0.045 | 0.0003 | 0.087 |
| E | 0.205 | 0.65 | 2.18 | 0.015 | 0.003 | 0.821 | 0.060 | 0.09 | 0.044 | 0.050 | 0.0050 | 0.098 | 0.101 | 0.080 | 0.0002 | 0.142 |
| F | 0.265 | 1.45 | 2.45 | 0.009 | 0.003 | 0.040 | 0.170 | 0.02 | 0.004 | 0.005 | 0.0020 | 0.050 | 0.100 | 0.055 | 0.0004 | 0.054 |
| G | 0.283 | 1.48 | 2.36 | 0.007 | 0.003 | 0.010 | 0.160 | 0.080 | 0.001 | 0.006 | 0.0018 | 0.093 | 0.100 | 0.036 | 0.0003 | 0.094 |
| H | 0.279 | 1.49 | 2.41 | 0.019 | 0.003 | 0.032 | 0.130 | 0.090 | 0.005 | 0.130 | 0.0020 | 0.001 | 0.120 | 0.078 | 0.0002 | 0.006 |
| I | 0.295 | 1.49 | 2.29 | 0.010 | 0.002 | 0.015 | 0.160 | 0.005 | 0.005 | 0.070 | 0.0015 | 0.006 | 0.100 | 0.085 | 0.0003 | 0.011 |
| J | 0.300 | 1.45 | 2.33 | 0.008 | 0.004 | 0.009 | 0.160 | 0.002 | 0.004 | 0.078 | 0.0029 | 0.004 | 0.210 | 0.045 | 0.0001 | 0.008 |
| K | 0.370 | 0.30 | 1.40 | 0.015 | 0.003 | 0.050 | 0.180 | 0.05 | 0.003 | 0.035 | 0.0070 | 0.040 | 0.010 | 0.060 | 0.0035 | 0.043 |
| M | 0.350 | 1.47 | 2.25 | 0.010 | 0.004 | 0.035 | 0.110 | 0.040 | 0.003 | 0.009 | 0.0021 | 0.090 | 0.018 | 0.020 | 0.0002 | 0.093 |

remainder Fe and other impurities the total content of impurities being ≤0.8% by mass

*= impurity

Comparative examples are underlined

TABLE 2

| Steel | Ac3 | T_MS [° C.] | FT | CT | tC [s] | CRD [%] |
|---|---|---|---|---|---|---|
| A | 840 | 403 | 900 | 500 | 12 | 50 |
| B | 796 | 416 | 840 | 500 | 15 | 50 |
| C | 834 | 369 | 880 | 390 | 22 | 50 |
| D | 823 | 343 | 860 | 610 | 4 | 50 |
| E | 802 | 406 | 900 | 500 | 12 | 50 |
| F | 818 | 334 | 860 | 410 | 19 | 75 |
| G | 818 | 329 | 900 | 500 | 12 | 50 |
| H | 821 | 329 | 920 | 570 | 10 | 50 |
| I | 819 | 326 | 950 | 590 | 6 | 50 |
| J | 816 | 323 | 880 | 450 | 16 | 50 |
| K | 771 | 334 | 900 | 500 | 12 | 50 |
| M | 808 | 305 | 900 | 500 | 12 | 25 |

TABLE 3

| Steel | TS [° C.] | ΘS [° C./s] | tS [s] | ΘQ [° C./s] | TQ [° C.] | tQ [s] | TP [° C.] | tP [s] |
|---|---|---|---|---|---|---|---|---|
| A | 885 | 5 | 55 | 35 | 320 | 4 | 454 | 50 |
| B | 890 | 10 | 35 | 50 | 537 | 4 | 470 | 10 |
| C | 905 | 8 | 85 | 20 | 330 | 8 | 460 | 85 |
| C | 925 | 5 | 75 | 25 | 340 | 6 | 450 | 75 |
| C | 925 | 5 | 75 | 25 | 340 | 6 | 450 | 75 |
| D | 830 | 10 | 200 | 30 | 215 | 10 | 400 | 209 |
| D | 830 | 3.5 | 118 | 16 | 215 | 10 | 460 | 199 |
| D | 880 | 10 | 200 | 30 | 215 | 10 | 400 | 195 |
| D | 830 | 3.5 | 118 | 16 | 285 | 10 | 460 | 199 |
| E | 930 | 3.5 | 105 | 35 | 400 | 10 | 400 | 370 |
| F | 890 | 10 | 200 | 30 | 260 | 10 | 400 | 190 |
| F | 870 | 3.5 | 118 | 20 | 240 | 10 | 460 | 93 |
| F | 870 | 10 | 200 | 30 | 280 | 10 | 400 | 225 |
| G | 890 | 10 | 200 | 15 | 280 | 10 | 400 | 180 |
| G | 885 | 3.5 | 118 | 19 | 210 | 10 | 460 | 103 |
| G | 820 | 3.5 | 118 | 20 | 240 | 10 | 460 | 93 |
| G | 900 | 3.5 | 118 | 30 | 260 | 10 | 460 | 44 |
| H | 890 | 3.5 | 149 | 30 | 215 | 10 | 380 | 99 |
| H | 895 | 3.5 | 149 | 30 | 215 | 10 | 430 | 93 |
| H | 880 | 3.3 | 133 | 47 | 235 | 15 | 460 | 86 |
| H | 885 | 3.3 | 133 | 47 | 215 | 12 | 460 | 86 |
| H | 879 | 3.3 | 133 | 47 | 215 | 17 | 460 | 86 |
| H | 880 | 3.3 | 133 | 47 | 215 | 20 | 460 | 86 |
| I | 880 | 3.3 | 133 | 47 | 260 | 30 | 460 | 86 |
| I | 875 | 3.5 | 149 | 30 | 215 | 10 | 380 | 99 |
| J | 880 | 3.3 | 133 | 47 | 215 | 20 | 460 | 86 |
| J | 880 | 3.3 | 133 | 47 | 215 | 20 | 430 | 86 |
| K | 835 | 10 | 150 | 50 | 150 | 5 | 250 | 500 |
| M | 900 | 10 | 133 | 47 | 215 | 20 | 430 | 81 |
| M | 900 | 10 | 133 | 47 | 215 | 20 | 480 | 86 |
| M | 900 | 10 | 195 | 30 | 150 | 10 | 400 | 165 |

TABLE 4

| Steel | YS [MPa] | TS [MPa] | YS/TS | A80 [%] | HER [%] | TS × A80 [MPa × %] |
|---|---|---|---|---|---|---|
| A | 1003 | 1096 | 92% | 9.8 | 39 | 12056 |
| B | 945 | 1330 | 71% | 10.7 | 10 | 15960 |
| C | 1020 | 1205 | 85% | 14.3 | 30 | 19280 |
| C | 855 | 1312 | 65% | 11.6 | 8 | 17056 |
| C | 845 | 1312 | 64% | 10.7 | 7 | 15744 |
| D | 1384 | 1436 | 96% | 14.2 | 20 | 22838 |
| D | 689 | 1457 | 47% | 11.9 | 2 | 19419 |
| D | 1252 | 1420 | 88% | 15.2 | 20 | 24174 |
| D | 699 | 1475 | 47% | 11.3 | 1 | 18668 |
| E | 688 | 1042 | 66% | 11.0 | 8 | 12817 |
| F | 1180 | 1338 | 88% | 13.5 | 26 | 20231 |
| F | 1180 | 1307 | 90% | 11.8 | 20 | 17273 |
| F | 1118 | 1331 | 84% | 14.0 | 14 | 20870 |
| G | 698 | 1378 | 51% | 7.8 | 3 | 11961 |
| G | 786 | 1437 | 55% | 13.4 | 5 | 21486 |
| G | 680 | 1491 | 46% | 10.2 | 0 | 17033 |
| G | 1236 | 1446 | 85% | 14.9 | 20 | 24131 |

TABLE 4-continued

| Steel | YS [MPa] | TS [MPa] | YS/TS | A80 [%] | HER [%] | TS × A80 [MPa × %] |
|---|---|---|---|---|---|---|
| H | 1280 | 1472 | 87% | 9.9 | 21 | 16253 |
| H | 1304 | 1505 | 87% | 10.6 | 21 | 17864 |
| H | 1056 | 1402 | 75% | 12.0 | 22 | 18817 |
| H | 1235 | 1396 | 89% | 13.2 | 24 | 20664 |
| H | 1235 | 1396 | 89% | 13.2 | 24 | 20664 |
| H | 1268 | 1413 | 90% | 13.0 | 20 | 20631 |
| I | 990 | 1432 | 69% | 14.5 | 11 | 23198 |
| I | 1280 | 1472 | 87% | 9.9 | 21 | 16253 |
| J | 1346 | 1453 | 91% | 14.8 | 21 | 24015 |
| J | 1359 | 1466 | 93% | 12.1 | 23 | 19868 |
| K | 1443 | 1721 | 84% | 6.6 | 28 | 12047 |
| M | 1035 | 1478 | 70% | 14.4 | 20 | 23831 |
| M | 980 | 1421 | 69% | 15.0 | 5 | 23829 |
| M | 1377 | 1536 | 90% | 0.0 | 20 | 19050 |

TABLE 5

| Steel | RA | tM | fM [%] | B + bF | pF | V(C, N) density [1/μm2] | H_sf |
|---|---|---|---|---|---|---|---|
| A | 11.0 | 72.0 | 3.0 | 4.0 | 10.0 | 0 | 0.52 |
| B | 5.0 | 35.0 | 15.0 | 45.0 | 0.0 | 0 | 0.48 |
| C | 15.0 | 72.0 | 2.0 | 8.0 | 2.0 | <50 | 0.46 |
| C | 16.0 | 67.0 | 0.0 | 16.0 | 0.0 | <50 | 0.48 |
| C | 16.0 | 66.0 | 0.0 | 18.0 | 0.0 | <50 | 0.49 |
| D | 16.0 | 75.0 | 6.0 | 3.0 | 0.0 | <50 | 0.47 |
| D | 23.0 | 52.0 | 2.0 | 8.0 | 15.0 | <50 | 0.47 |
| D | 16.0 | 76.0 | 4.0 | 4.0 | 0.0 | <50 | 0.45 |
| D | 16.0 | 33.0 | 29.0 | 15.0 | 7.0 | <50 | 0.45 |
| E | 15.0 | 64.0 | 1.0 | 20.0 | 0.0 | 1095 | 0.40 |
| F | 15.0 | 70.0 | 2.0 | 10.0 | 2.0 | 1075 | 0.34 |
| F | 12.0 | 72.0 | 12.0 | 4.0 | 0.0 | 1125 | 0.27 |
| F | 14.5 | 52.0 | 6.0 | 27.0 | 0.0 | 1095 | 0.33 |
| G | 16.0 | 39.0 | 12.0 | 12.0 | 21.0 | 1110 | 0.32 |
| G | 16.5 | 71.0 | 0.0 | 1.0 | 11.5 | 1220 | 0.30 |
| G | 17.0 | 43.0 | 5.0 | 20.0 | 15.0 | 1125 | 0.29 |
| G | 18.5 | 69.0 | 2.0 | 10.0 | traces | 1075 | 0.28 |
| H | 13.5 | 82.0 | 4.5 | 0.0 | 0.0 | 1025 | 0.29 |
| H | 13.5 | 78.0 | 7.0 | 1.0 | traces | 1075 | 0.35 |
| H | 15.5 | 75.0 | 2.0 | 7.5 | 0.0 | 1150 | 0.34 |
| H | 16.5 | 78.0 | 0.0 | 5.0 | 0.0 | 1200 | 0.23 |
| H | 16.5 | 79.0 | 0.0 | 4.0 | 0.0 | 1250 | 0.25 |
| H | 17.0 | 80.0 | 3.0 | 0.0 | 0.0 | 1225 | 0.29 |
| I | 17.5 | 66.0 | 3.0 | 13.0 | 0.0 | 1050 | 0.29 |
| I | 13.5 | 74.0 | 9.5 | 3.0 | 0.0 | 1035 | 0.28 |
| J | 14.0 | 73.0 | 8.0 | 5.0 | 0.0 | 1450 | 0.17 |
| J | 12.0 | 74.0 | 10.0 | 4.0 | 0.0 | 1275 | 0.28 |
| K | 1.0 | 95.0 | 0.0 | 4.0 | 0.0 | 1100 | 0.39 |
| M | 22.5 | 72.0 | 5.0 | 0.0 | 0.0 | 1075 | 0.33 |
| M | 15.5 | 69.0 | 3.0 | 12.0 | 0.0 | 1295 | 0.32 |
| M | 8.0 | 91.0 | 1.0 | 0.0 | 0.0 | 1200 | 0.35 |

The invention claimed is:

1. A high strength, cold rolled steel flat product, the steel flat product comprising a steel substrate consisting of, in % by mass, C: 0.20 to 0.40%,
Mn: 1.50 to 3.00%,
Si: 0.90 to 1.50%,
A1 0.005 to 1.00%,
V: 0.07 to 0.30%,
optionally Cr: 0.01 to 1.00%,
optionally Mo: 0.005 to 0.20%,
optionally B: 0.00001 to 0.002%,
optionally Nb and Ti the total content of Nb and Ti being 0.005 to 0.2%,
P: up to 0.020%,
S: up to 0.005%,
N: up to 0.008%, and as the remainder Fe and unavoidable impurities, the sum of the shares of the impurities being ≤0.8%, and exhibiting a microstructure determined in accordance with ISO 9042 comprising, in % by area, 65 to 92% primary (tempered) martensite and at least 8% retained austenite (RA), the remainder being filled by:

up to 27% of secondary (un-tempered) martensite, up to 10% of bainite or bainitic ferrite, and/or up to ≤5% polygonal ferrite, the sum of the shares of the secondary (untempered) martensite, the bainite or bainitic ferrite and the polygonal ferrite being ≤27%, wherein the microstructure of the steel substrate has a precipitate density of ≥1000 per $\mu m^2$ of V-based-precipitates with a diameter of less than 10 nm determined by measuring the precipitates in carbon extraction replicas of a longitudinal section of the steel flat product by transmission electron microscope images in combination with X-ray microanalysis in 5 measuring fields and averaging the results of the 5 measurement fields.

2. The steel flat product according to claim 1, wherein the primary martensite contained in the microstructure of the steel substrate has a fine lath structure which laths have a maximum length of 1000 nm determined by scanning electron microscopy using sections treated with a 3% Nital etch which were taken at one third of the plate thickness of the steel substrate and averaging the results of five measurements.

3. The steel flat product according to claim 2, wherein the maximum length of the laths is 500 nm determined by scanning electron microscopy using sections treated with a 3% Nital etch which were taken at one third of the plate thickness of the steel substrate, and averaging the results of five measurements.

4. The steel flat product according to claim 1, wherein the C content of the steel of the steel substrate is 0.22 to 0.3% by mass.

5. The steel flat product according to claim 1, wherein the Mn content of the steel of the steel substrate is 1.9 to 2.8% by mass.

6. The steel flat product according to claim 1, wherein the V content of the steel of the steel substrate is 0.07 to 0.20% by mass.

7. The steel flat product according to claim 1, wherein the steel flat product has a yield strength of at least 1000 MPa, a tensile strength of at least 1300 MPa and an elongation A80 of at least 10% each determined according to DIN EN ISO 6892 (sample form 2).

8. The steel flat product according to claim 1, wherein the steel flat product has a hole-expansion determined according to ISO 16630 of at least 20%.

9. The steel flat product according to claim 1, wherein an anti-corrosion coating is provided on at least one of the surfaces.

10. The steel flat product according to claim 9, wherein the coating is applied by electrolytically coated, hot-dip galvanizing or galvannealing.

11. A method for the manufacture of the steel flat product according to claim 1, comprising the following working steps:

a) providing a steel melt consisting of, in % by mass, C: 0.2 to 0.4%, Mn: 1.5 to 3.0%, Si: 0.9 to 1.5%, Al: 0.005 to 1.0%, V: 0.07 to 0.3%, optionally Cr: 0.01 to 1.00%, optionally Mo: 0.005 to 0.20%, optionally B: 0.00001 to 0.002%, optionally Nb and Ti the total content of Nb and Ti being 0.005 to 0.2%, P: up to 0.020%, S: up to 0.005%, N: up to 0.008%, and as the remainder Fe and unavoidable impurities, the sum of the shares of the impurities being ≤0.8%;

b) casting the steel melt into a slab;

c) heating through the slab to a reheating temperature of 1000 to 1300° C.;

d) hot rolling the reheated slab into a hot strip, wherein the hot rolling is finished at a hot rolling finish temperature of 850 to 980° C.;

e) cooling the hot strip to a coiling temperature of 400 to 600° C., the cooling being finished within a maximum of 25 s after the finish of the hot rolling, and coiling the hot strip into a coil;

f) optionally pickling the hot strip;

g) cold rolling the hot strip into a cold strip with cold reduction rates of 20 to 80%, h) final annealing of the cold strip by:

heating the cold strip to a soaking temperature TS, which is at least 50° C. higher than the Ac3 temperature of the respective steel and 950° C. at most, with a heating rate ΘS of 2 to 10° C./s, wherein the Ac3 temperature of the respective steel is determined using dilatometry, immediately followed by holding the cold strip at the soaking temperature TS for a soaking time tS of more than 40 s and less than 200 s;

immediately followed by quenching the cold strip with a quenching rate ΘQ of 20 to 100° C./s to a quenching stop temperature TQ which is lower than the martensite start temperature T_MS of the steel and at least equal to that temperature TQ_min at which in the microstructure of the cold strip 65 to 92% by area primary martensite is present, wherein the T_MS temperature of the steel is determined using dilatometry according to September 1681-1998-06;

and holding the annealed cold strip at the quenching stop temperature TQ for 4 to 20 s;

i) over-aging the final annealed cold strip with the over-aging treatment comprising of:

heating the annealed cold strip to an over-aging temperature TP of 380 to 460° C., then holding the annealed cold strip at the over-aging temperature for 50 to 200 s, and, then cooling the annealed cold strip to less than 100° C. with a cooling rate ΘC of 0.5 to 20° C./s.

* * * * *